United States Patent [19]

Indelicato

[11] 4,160,333

[45] Jul. 10, 1979

[54] SIGNAL TUBE

[76] Inventor: Alphonse Indelicato, 7612 Wydown Blvd., Clayton, Mo. 63105

[21] Appl. No.: 898,634

[22] Filed: Apr. 21, 1978

[51] Int. Cl.[2] ..... G09F 3/00

[52] U.S. Cl. ..... 40/322; 223/85

[58] Field of Search ..... 233/85, 88, 91, 92, 233/98; 40/322; 223/85

[56] References Cited

U.S. PATENT DOCUMENTS

| | | | |
|---|---|---|---|
| 3,112,050 | 11/1963 | Eason | 223/98 |
| 3,120,913 | 2/1964 | Glowka | 223/98 |
| 3,409,224 | 11/1968 | Harp et al. | 138/121 X |
| 3,716,733 | 2/1973 | Keith et al. | 138/121 X |
| 3,898,754 | 8/1975 | Johansson | 40/322 |
| 4,040,545 | 8/1977 | Hill | 223/85 |

*Primary Examiner*—George H. Krizmanich
*Attorney, Agent, or Firm*—Rogers, Eilers & Howell

[57] ABSTRACT

A tube of plastic or the like having a flexible bellows middle section and straight section ends with identifying indicia of color or shape thereon to represent information about garments contained on clothing hangers. It may have a flared section and a tapered section on opposing ends of the signal tube; the flared section to fit about the shoulders of a hanger and the tapered section to fit snugly about the neck area. The flared section may have locking nibs to help secure the signal tube to the neck of the hanger. Serrations may extend upwardly from the upper straight section to permit a closer fit to the hanger and help prevent the accidental removal of the signal tube.

8 Claims, 8 Drawing Figures

SIGNAL TUBE

BACKGROUND AND SUMMARY

It is crucial to the successful operation of a dry cleaning establishment that the owner or operator have a system whereby he can keep track of a customer's clothes not only during the cleaning operation but after the cleaning operation has been completed as well. To accomplish this, various systems including conveyors and other types of storage devices have been developed for maintaining completed dry cleaning in an orderly manner and also allowing random access to a wide variety of customer orders. The most commonly used system involves a conveyor which supports the hangers containing the finished clothes and which can be operated to move the clothes past an attendant so that the attendant may quickly select the customer's order.

A major problem encountered in the use of these storage and access systems is that garments, especially single or small garments on a single hanger become lost. This may occur when the attendant hands out cleaned garments to a customer, and accidentally delivers the single hanger order with the group of hangers containing the customer's actual order. Also, it is sometimes difficult to identify a particular customer's order or to determine the beginning and end points of a customer's order along the conveyor, assuming that all of a customer's order is kept together. For example, a customer may deliver four garments to a dry cleaner for cleaning and these garments may in turn be supported by two hangers on the conveyor. It would take a substantial amount of time to examine each of several thousand hangers to find the order and then be certain that the order is wholly contained on the two hangers without some sort of coding system. While larger orders may be easier to locate on the conveyor, it would take a proportionately longer amount of time to determine the beginning and end points of the order.

The use of tags stapled to a garment cover and numbered in some manner gives no provision for avoiding the attendant's accidentally picking up more than the customer's order, especially if there is a small order immediately adjacent that customer's order. Other indicia use color-coded devices applicable to safety pins (U.S. Pat. No. 2,564,029) to distinguish laundry bags. These are too small to be used on a coat hanger and lack the middle bellows to enable them to bend around a curved hanger hook. Other prior efforts have included hook covers (U.S. Pat. No. 3,120,913) sometimes color-coded (U.S. Pat. No. 3,112,050) or color-coded hanger spacers (U.S. Pat. No. 3,482,746), but these are permanent additions to the hangers, are too expensive to be used for present purposes, and/or are too large and bulky to be used for present purposes. Also, this type of system does not aid the location of small orders on the conveyor as the tags are usually all placed in a similar location on the garments and a fast conveyor speed merely blends the colors or code together.

Most dry cleaners handle a large proportion of their business in small orders and losses from these small orders may be quite substantial. Thus, it becomes not only a financial matter but also one of customer satisfaction that an operator of a dry cleaning establishment provide for the careful and efficient handling of smaller orders.

Applicant has succeeded in developing a very inexpensive indicator tube device which allows an attendant to easily mark and identify any order and distinguish it from other garments. Applicant's invention includes a small, plastic tubular body of plastic material such as polystyrene that is somewhat stiff, having a medial unitary bellows section enabling the device to bend so that it can be fitted over the hook end of a hanger and slid down to the neck area where it may be readily seen and observed by an attendant as he indexes the conveyor along. The signal tube may carry identifying colors or distinguishing shapes by which it can clearly indicate the same quality of the products on the hanger, or of the order involved with them. For example, the indicia may identify it both as a small order and also the type of garment carried on the hanger. Any type of color or pattern configuration may be used to encode the signal tubes and is limited only by the imagination of the user. In addition, identifying structure which either protrudes or is otherwise readily seen may be added to the signal tube to provide a greater combination of coding. Applicant's invention is much more effective than systems previously used as the signal tube slides over the hook and rests on the neck of the hanger at a level above the confusing array of clothes and garment bags. Thus, an attendant's eye can easily pick out and identify a greater number of orders than before.

The device may be shaped, as will appear, with a flared section and a tapered section at opposite ends thereof, to enable it to fit snugly around the shoulder area of the hanger and to provide a snug fit at the top of the signal tube adjacent the neck area. Locking nibs may be provided at the lower end of the flared section and snap over the shoulder area of the hanger to aid in securing the signal tube to the hanger. Either of the shapes disclosed herein may have serrations extending upwardly from the top straight section to provide a more snug fit and help prevent the accidental removal of the signal tube from the hanger.

DESCRIPTION OF THE PREFERRED EMBODIMENT

Figure 1:
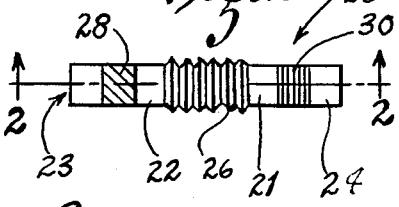
FIG. 1 is a side elevational view of a signal tube.
Figure 2:
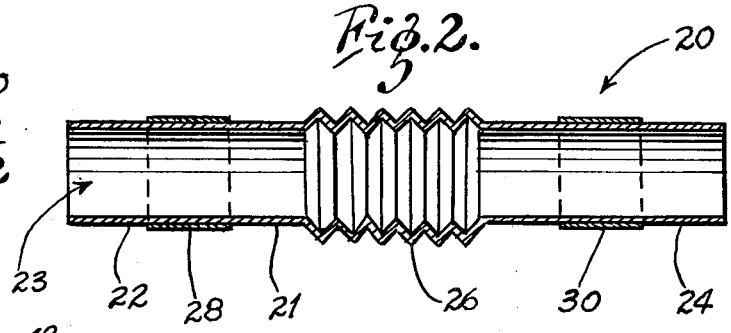
FIG. 2 is an enlarged cross-sectional view taken along the plane of line 2—2 in FIG. 1.
Figure 3:
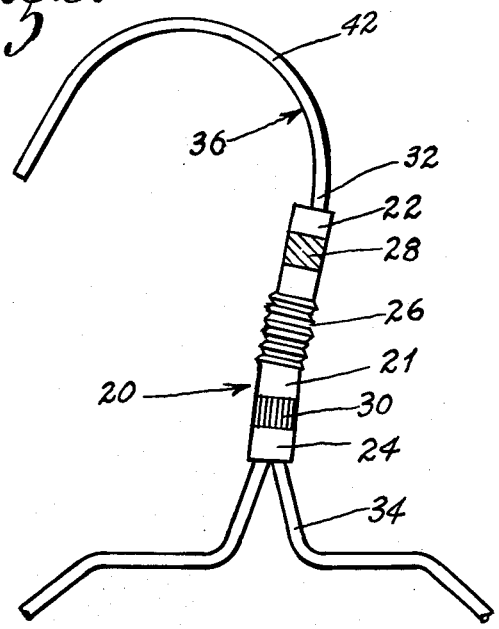
FIG. 3 is a perspective view of the signal tube as installed on the neck of a hanger.

As shown in FIGS. 1, 2, and 3, applicant's invention of a signal tube 20 includes a tube 21 having a central cavity 23, a top straight section 22, and a bottom straight section 24 joined by a central flexible bellows section 26. The device is preferably made of a sanitary piece of tubular plastic, and can be cut from a bendable hospital drinking straw, formed with the relatively stiff ends and a bendable bellows or accordion portion in between. The flexible bellows 26 may be provided elsewhere along the length of the signal tube 20 but applicant has found that maximum ease in installing and removing the signal tube 20 is obtained when the flexible bellows 26 is disposed in the approximate middle of the signal tube 20.

An identifying band 28 is disposed around the top straight section 22 and is lined for green to indicate that it may be colored or otherwise encoded. Likewise, an identifying band 30 is disposed around the bottom straight section 24 and is lined for red to indicate that it may also carry an identifying code, including any particular color or pattern. Applicant notes that the choice of color or other pattern is limited only by the imagination of the user and applicant does not intend to limit the choice of code to that shown and described in the preferred embodiment.

The flexible bellows 26 allows the top straight section 22 to be bent at a substantial angle from the bottom straight section 24 without damage to the signal tube 20 and without requiring that the signal tube 20 remain in such a bent condition. The signal tube 20 including the straight sections 22, 24 and flexible bellows 26 may be formed similarly to what is commonly referred to as a hospital straw with a flexible section so that it can be bent to allow one who is bedridden to drink fluid from a container.

Figure 4:
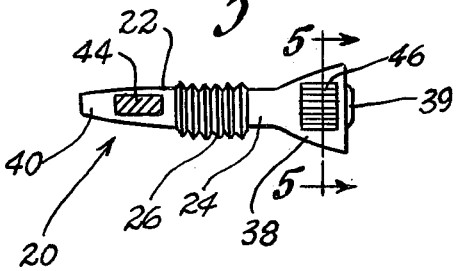
FIG. 4 is a side elevational view of the second embodiment of applicant's signal tube.
Figure 5:
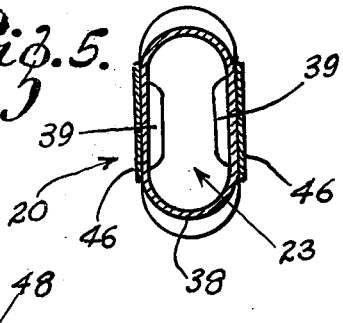
FIG. 5 is an enlarged cross-sectional view detailing the flared end of applicant's second embodiment taken along the plane of line 5—5 in FIG. 4.
Figure 6:
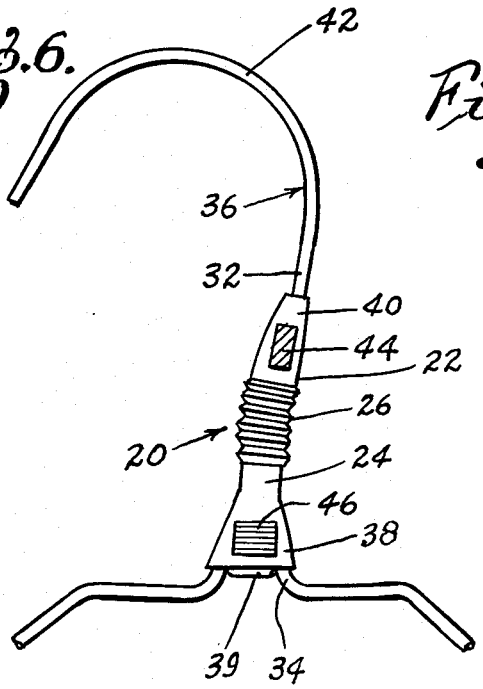
FIG. 6 is a perspective view of applicant's second embodiment installed on a hanger.

As shown in FIGS. 4, 5 and 6, a second embodiment incorporates several modifications which permit a snug fit of the signal tube 20 about the neck 32 and shoulders 34 of a hanger 36. The bottom straight section 24 has a flared section 38 with an angle of flare which closely approximates that of the shoulder 34 of a typical wire hanger 36. Thus, the flared section 38 allows the bottom of the signal tube 20 to fit snugly about the shoulders 34 and remain in a fixed position relative to the neck 32 of the hanger. Locking nibs 39 may be provided at the lower end of the flared section 38 and extend inwardly to secure the flared section 38 to the shoulder 34 of the hanger. Although applicant discloses two locking nibs 39, one attached to each side of the flared section 38, any number may be used. At the opposite end, a tapered section 40 is provided which tapers from the top straight section 22 to closely approximate the cross-sectional area of the hook section 42 of the hanger. This greatly reduces the tendency of the signal tube 20 to accummulate dust or debris and act as a funnel for debris to flow into a communicating garment bag (not shown) containing the finished dry cleaning. The taper 40 may be desirable if the garment bags are not otherwise sealed at the top and there is a possibility of the signal tube 20 acting as a funnel. In this embodiment, the signal tube 20 remains stationary and does not rotate about the neck 32 of the hanger. Thus, different types of coding may be used and smaller patches of coding may be used as a predetermined part of the signal tube 20 will always face the attendant when the hanger 36 is contained within the conveyor or other storage system. A top code patch 44 and a bottom code patch 46 are shown in FIGS. 4, 5 and 6 and are lined for brown and blue respectively to indicate that a smaller amount of identifying code may be used on any particular signal tube 20. This makes it possible to multi-code a signal tube 20 and merely reverse the direction that the signal tube 20 is pointing to change the code. Each single signal tube 20 may then carry at least two different codes and half the amount of inventory is required to implement a particular code system.

Figure 7:
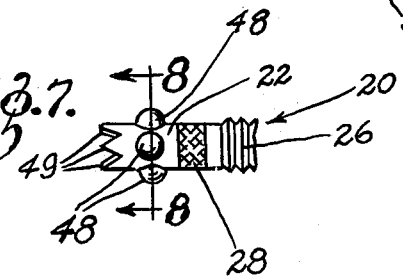
FIG. 7 is a fragmentary view of a modification of applicant's signal tube showing protuberances.
Figure 8:
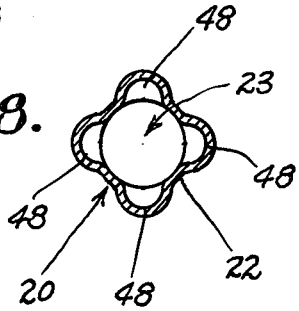
FIG. 8 is an enlarged cross-sectional view detailing the protuberances taken along the plane of line 8—8 in FIG. 7.

Modifications may be incorporated into either embodiment and are shown in FIGS. 7 and 8. One modification includes the placement of protuberances 48 or other identifying structure along the top or bottom straight sections 22, 24. These protuberances 48 may be particularly helpful in adding versatility to the coding system as they can be used in combination with an identifying band 28, 30 or a code patch 44, 46. The protuberances 48 may take any desired shape, including that of a hemisphere as shown in the drawings. It is only necessary that the protuberances 48 be readily recognizable by an attendant as containing part of the coded information on the signal tube 20.

A second modification includes the addition of serrations 49 along the top of the upper straight section 22 or tapered section 23. These serrations 49 permit the central cavity 23 or the tapered section 40 to be smaller and thus provide a more snug fit about the hanger 36. Accidental removal of the signal tube 20 is also more difficult with serrations 49 as it tends to tangle and jam up as the signal tube 20 is moved up on the hanger 36 unless the signal tube 20 is moved somewhat purposefully.

In use, the identification device can be slipped over the free end of the hook of a coat hanger, and around to the position indicated in the drawings. Typically, it may have an inner diameter of about ¼ inch or 6 mm. Each straight section may be about ¾ inch or 18 mm long, and the bellows section about ⅜ inch or 9 mm. With those dimensions, the device can be readily slipped over the hook of a coat hanger, without significant resistance. In other words, the straight sections are short enough to fit around the curved hook of the usual hanger, without distortion, and the bendable bellows enables the device to have enough length to project above the garment bag and be clearly visible. The overall length should thus be about ¾ inch or 18 mm to about 2 inches or 50.8 mm so as to be received by the neck section of the hanger.

While the device could be made without the bellows section, such would be less desirable. It would not slip nearly as readily over the hanger hook, and could be collapsed or deformed in installation or removal. And while these devices are very cheap, the cleaner may wish to remove them upon delivery of the garments and re-use them, as is possible with the bellows. A ¼ inch or 6 mm diameter tube longer than about 1 inch or 25.4 mm cannot slip readily around the hook, but rather must be forced and distorted. Yet, with the bellows, the device can be made as much as 2 inches or 50.8 mm or more without interferring with installation or removal. Thus, the device can be made larger, be more visible, and afford greater area for colors and other code indexing.

The description of the device and its use has been directed primarily towards its use in combination with clothes hangers. That is its primary use, but many others suggest themselves, both in dry cleaning establishments and elsewhere.

There are various changes and modifications which could be made to applicant's invention and which would be obvious to one of ordinary skill in the art. These changes and moficiations are included within the teaching of applicant's invention and applicant intends that his invention be limited only by the scope of the claims appended hereto.

I claim:

1. A signal tube for use with a hook-shaped member such as a clothing hanger having an arcuate shaped hook to suspend the hanger from a support, a body adapted to support articles of clothing therefrom, and a neck interconnecting the hook with the body; the signal tube comprising a tube means about ¾ inch or 18 mm to about 2 inches or 50.8 mm in length, having a central cavity extending the length thereof and adapted to receive and pass therethrough a hook of a hanger, said central cavity having a diameter approximately 3 times that of the neck, the tube means having a relatively stiff unbendable section and an integral continuous flexible bellows section, the latter allowing substantial bending of said tube means to facilitate the passage of said tube means over the hook as the signal tube is installed or removed from the hanger, and means to encode the tube means so that information about the hanger and its contents may be determined by observing said encoded tube means.

2. The device of claim 1 wherein the bellows is medially located in the tube means and the tube means has a straight section on either end thereof.

3. The device of claim 1 wherein the tube means has at least one straight section and the encoding means is secured to said straight section.

4. The device of claim 1 for use with a hanger that has a shoulder between the body and the neck and the tube means has a flared section at an end which approximates the shape of said shoulder to permit a snugness of fit between said flared section and said shoulder and a tapered section at the tube means opposite end which approximates the cross-sectional area of the neck, thereby providing a snugness of fit between said tapered section and said neck.

5. The device of claim 1 wherein the encoding means includes a series of protuberances positioned circumferentially about the tube means.

6. The device of claim 1 in combination with the hanger whereby it gives information as to any garments on the hanger.

7. The device of claim 1 further comprising serrations extending upwardly from the upper end of the tube means.

8. The device of claim 4 further comprising at least one locking nib extending inwardly from a lower end of the flared section, said locking nib being adapted to secure the signal tube to the hanger to hinder accidental removal thereof.

* * * * *